United States Patent [19]

Eisenlohr

[11] Patent Number: 4,715,408

[45] Date of Patent: Dec. 29, 1987

[54] GAUZE OR LENO HARNESS FOR WEAVING MACHINES

[76] Inventor: Franz Eisenlohr, Im Bühl, Tuttwil, Switzerland

[21] Appl. No.: 15,860

[22] PCT Filed: Aug. 11, 1986

[86] PCT No.: PCT/CH86/00116

§ 371 Date: Jan. 20, 1987

§ 102(e) Date: Jan. 20, 1987

[87] PCT Pub. No.: WO87/01398

PCT Pub. Date: Mar. 12, 1987

[30] Foreign Application Priority Data

Sep. 2, 1985 [EP] European Pat. Off. ... EP85111068.4

[51] Int. Cl.[4] ..... D03D 47/40

[52] U.S. Cl. ..... 139/54

[58] Field of Search ..... 139/50, 54

[56] References Cited

U.S. PATENT DOCUMENTS 4,066,105 1/1978 Heinrich et al. ..... 139/54

4,589,450 5/1986 Eisenlohr ..... 139/54

FOREIGN PATENT DOCUMENTS 1000110 2/1952 France .

1403532 3/1965 France .

*Primary Examiner*—Henry S. Jaudon

*Attorney, Agent, or Firm*—Kenyon & Kenyon

[57] ABSTRACT

The gauze or leno harness comprises a frame-like carrier (2) for a crossing yarn (16) and a guide (4) for a standing yarn (7). A U-shaped guide or deflecting element (20) reciprocates the crossing yarn (16) between the two lanes (13 and 14) of the carrier (2), the crossing yarn (16) crossing the standing yarn (7) in its movements. The element (20) is borne with freedom of movement on the base of the passage (15) between the two lanes (13) and (14). Since the element (20) is freely movable, it cannot become sluggish as a result of becoming dirty.

13 Claims, 14 Drawing Figures

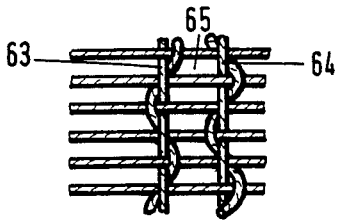
FIG. 6
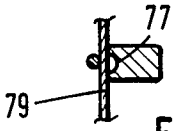
FIG. 8
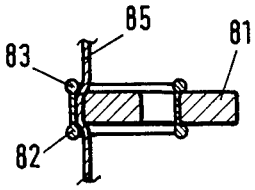
FIG. 9
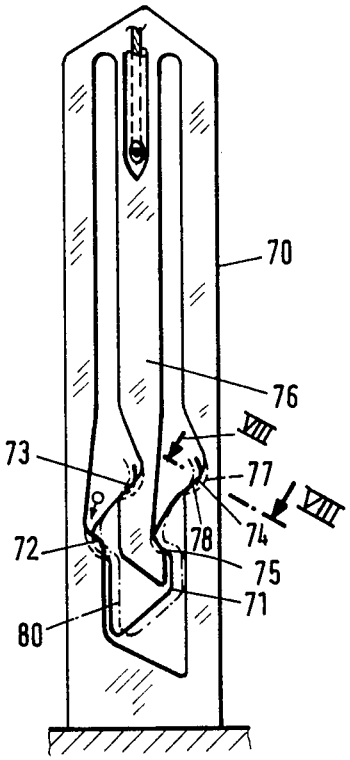
FIG. 7
FIG. 10
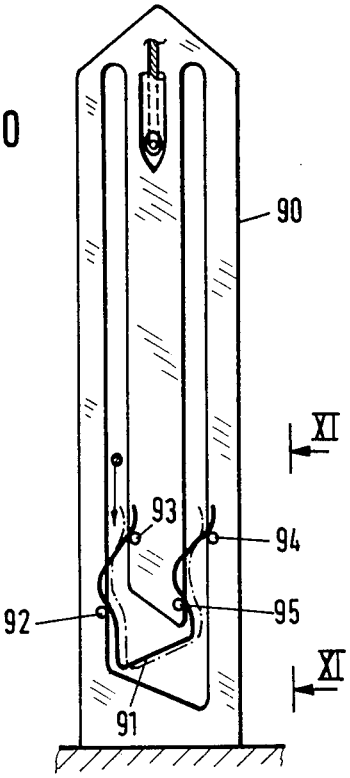
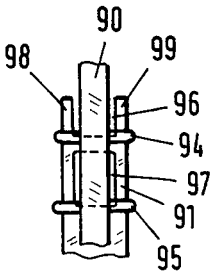
FIG. 11

GAUZE OR LENO HARNESS FOR WEAVING MACHINES

The invention relates to a gauze or leno harness for weaving machines.

Heretofore, various types of gauze or leno harnesses have been known for weaving machines. Generally, such a harness includes a stationary frame-like carrier having a central web which separates two lanes or slots and a connecting passage which connects the lanes. The carrier is positioned so that a crossing yarn may move from one lane to the other during a shed-changing operation of the weaving machine. In addition, such a harness is usually provided with a guide for a standing yarn which is reciprocated between the two lanes counter to the shed-changing operation. In order to guide the carrier yarn between the lanes, a guide element is provided near the connecting passage in order to guide the crossing yarn during the between-lane movement. During a shed change, the crossing yarn can be caused to cross over the stationary yarn each time that the crossing yarn passes from one lane to the other of the carrier. Such a harness is described in European Patent Application No. 84105316.8; however, such a harness suffers from the disadvantage of taking up relatively considerable width in relation in the warp yarn compacting width. Also, the element which guides the crossing yarn and which is in the form of a switch or a spoked wheel tends to become sluggish because of dirt.

Briefly, the invention provides a leno harness for a weaving machine which is comprised of a frame-like carrier, a guide and a guide element.

The frame-like carrier includes a central web, a pair of lanes on opposite sides of the web for guiding a crossing yarn therein and a passage having an inclined base connecting the lanes with each other for guiding the crossing yarn therebetween The guide is of generally known construction for a standing yarn and is mounted centrally of the lanes of the carrier for reciprocating movement relative to the central web of the carrier during a shed change.

The guide element includes a pair of arms which extend about the web of the carrier with a clearance at least equal to the thickness of the crossing yarn and with each arm disposed in a respective lane. In addition, the guide element has a yoke which interconnects the arms and which rests on the inclined base of the carrier.

In one embodiment, the carrier is constructed so that each lane has a widening extending over the length of a respective arm of the guide element. This facilitates passage of a crossing yarn by the inside and outside surfaces of each arm of the guide element as the case may be.

In another embodiment, the guide element is a one-piece U-shaped element. In this embodiment, the guide element includes a pair of grooves on opposite sides which slidably receive the carrier. In this respect, the guide element is thicker than the carrier.

In another embodiment, the guide element is in the form of a spring wire and the carrier includes grooves receiving at least two ends of the arms of the spring wire.

In still another embodiment, the guide element is in the form of a spring strip which is of a width equal to the thickness of the carrier and which has a pair of thickened edges. Alternatively, the spring strip may be held in place by being supported on a plurality of pins on the carrier.

Embodiments of the subject of the invention will be described hereinafter with reference to the drawings wherein:

FIG. 1 is a perspective view of a gauze or leno harness according to the invention;

FIGS. *2a–2c* show the guide or deflecting element of the harness in various movement phases;

FIG. 6 shows some of a fabric with an edge for cutting;

FIG. 7 shows another embodiment of a gauze or leno harness;

FIG. 8 is a cross-section on the line VIII—VIII of FIG. 7;

FIG. 9 shows another embodiment of a guide element or deflecting element;

FIG. 10 shows another embodiment of a gauze or leno harness, and

FIG. 11 is a view in side elevation looking in the direction indicated by arrows XI—XI in FIG. 10.

Figure 1:
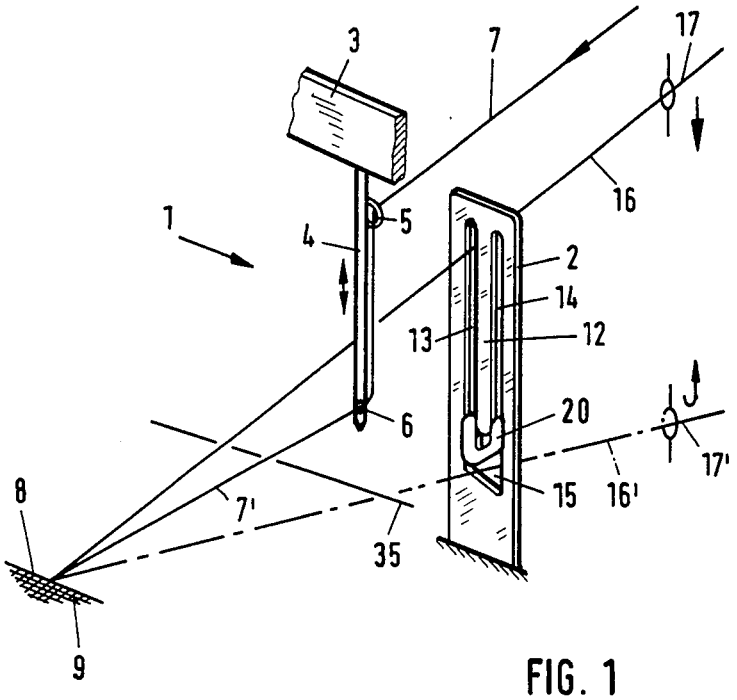

Referring to FIG. 1, a gauze or leno harness 1 comprises a frame-like carrier 2 for a leno or crossing yarn, the carrier being fixedly secured to a weaving machine (not shown), and a guide 4 for a standing yarn, the guide 4 being secured to a shaft 3. The guide 4 has a yarn carrier 5 at its top end and a yarn eye 6 at its bottom end. A standing yarn 7 is paid off a supply bobbin and passes through the carrier 5 and eye 6 to a shed apex 8 of a fabric 9.

The carrier 2 has a central web 12 and two lanes 13, 14 on opposite sides of the web 12 interconnected by a passage 15. The guide 4 is disposed centrally between the two lanes 13, 14. A leno or crossing yarn 16 is paid off the warp beam (not shown) through a heddle 17 of a shaft (not shown) disposed behind the shaft 3 and thence alternately through the lanes 13, 14 to the shed apex 8, in a manner to be described hereinafter. With the heddle 17 in the top position shown, the crossing yarn 16 is disposed in the left-hand lane 13 of the carrier 2; when the heddle 17 is in the bottom shed position the yarn 16 is disposed in the passage 15 and has the reference 16' therein. The guide 4 can be secured to some other drive element, such as a jacquard attachment, instead of to a shaft.

The carrier 2 has an element 20 for guiding or deflecting the crossing yarn 16; the element 20 is more clearly visible in FIG. *2a*. The element 20 is U-shaped and has an aperture 21 between two arms 22, 23. Element 20 rests by way of its yoke 20' on an inclined base 24 of the passage 15 and by way of a side 25 of the arm 23 on an inside 26 of the lane 14. An inside 27 of the arm 22 rests on a narrowing part 12' of the central web 12. With the element 20 thus positioned, there is a passage 29 between an inside 30 of the lane 13 and the arm 22 and a passage 31 between the narrowing part 12' of the central web 12 and an inside 33 of the arm 23. Both arms 22, 23 are disposed in a widened part 13', 14' respectively of the lanes 13, 14 respectively. This ensures that the crossing yarn cannot in its movements enter the wrong passage, as will become apparent hereinafter. A possible guiding of the element 20 in the carrier 2 will also be described with reference to FIG. 5.

Figures 2A, 2B, 2C, 2D:
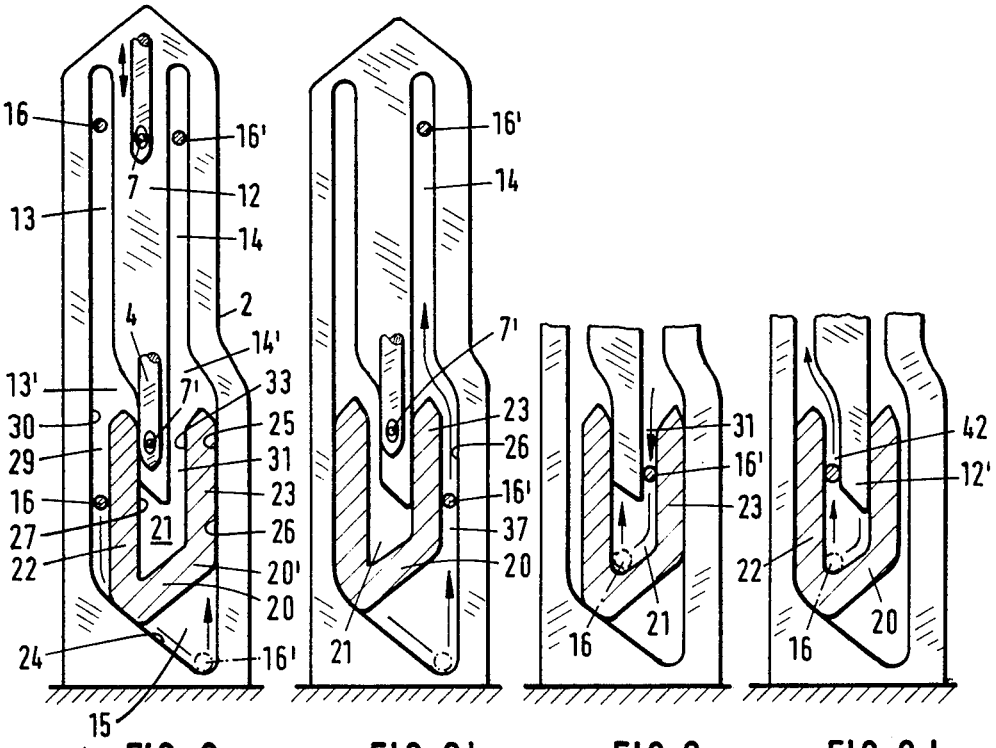
Figure 3:
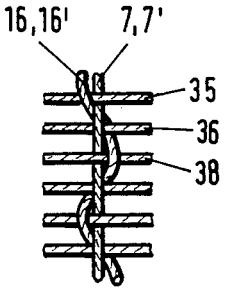
FIG. 3 shows some of a fabric having a gauze edge.

The harness operates as follows:

Before the start of the crossing movement the yarn 16 is in the top shed position in the left-hand lane 13. The guide 4 with the standing yarn 7 is in the bottom shed position and has the reference 7' in such position. The element 20 rests on the base 24 of the passage 15, in the manner shown in FIGS. 1 and 2*a*. When in the bottom shed movement, the heddle 17 moves the yarn 16 downards in the lane 13, the yarn 16 passage 29 lifting the element 20 and slides over the inclined base 24 to the right. In this position the yarn 16 has the reference 16'. Simultaneously, the guide 4 with the standing yarn 7' is raised by the shaft 3 into the top shed position 7. The crossing yarn 16 and the standing yarn 7 therefore cross one another, the crossing yarn 16 crossing above a picked weft yarn 35 while the standing yarn 7' crosses therebelow. The weft yarn is therefore secured (FIG. 3).

The next weft yarn 36 is then picked. At the next shed-changing the crossing yarn 16' rises, crossing under the weft yarn 36. As it rises the yarn 16' displaces the element 20 to the left and creates for itself a passage 37 between arm 23 and inside 26 of the crossing-yarn carrier (FIG. 2*b*), then enters the right-hand lane 14. The standing yarn 7 has simultaneously descended into the position 7', crossing above the weft yarn 36. The element 20 returns to the position shown in FIG. 2*c*. After the next weft yarn 38 has been picked, the next shed-changing occurs; the yarn 16' in the lane 14 descends whereas the yarn 7' rises. The yarn 16' slides through the passage 31 between the web 12 and the arm 23 and enters the aperture 21 of the element 20 (FIG. 2*c*). At the next shed-changing, in which the crossing yarn 16 rises, the yarn 16 moves the element 20 to the left and creates for itself a passage 42 between the narrowing part 12' of the web 12 and the left-hand arm 22 of the element 20 (FIG. 2*d*). As the crossing yarn 16 rises in the lane 13, the standing yarn 7 descends. One crossing or leno cycle has therefore been completed.

Figure 4:
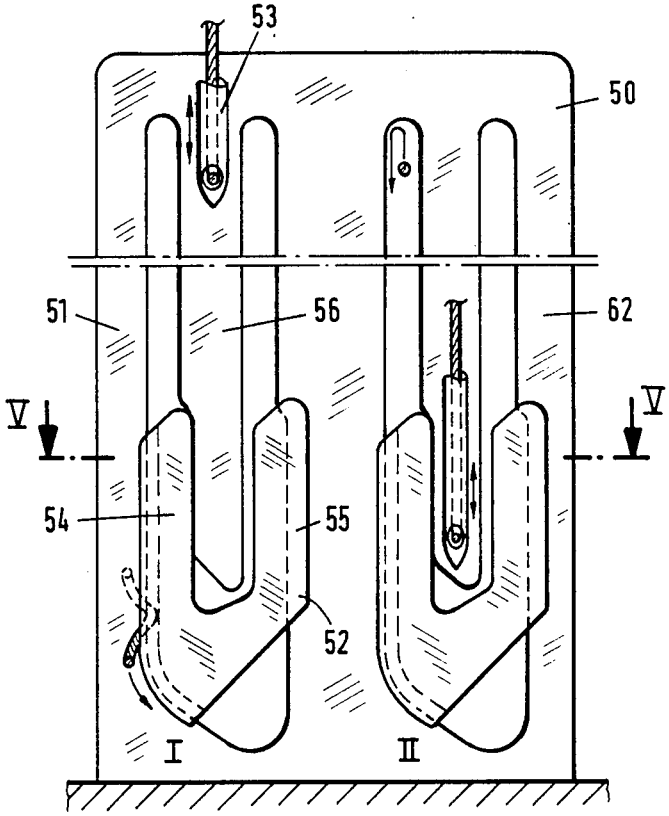
FIG. 4 shows a double gauze or leno harness.
Figure 5:
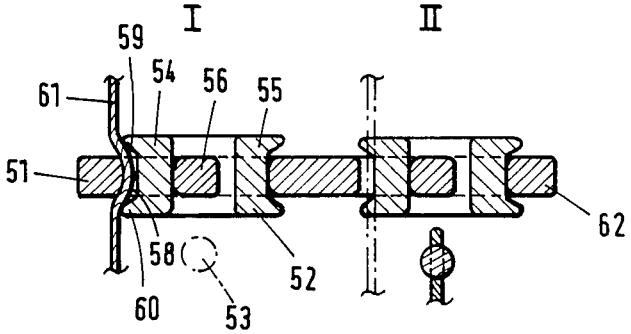
FIG. 5 is a cross-section on the line V—V of FIG. 4.

Referring to FIG. 4, if the fabric is required to have an edge for cutting—i.e., to have two adjacent gauze edges between which the fabric can subsequently be separated—the harness is duplicated. In this regard two gauze harnesses I, II are formed in a common baseplate 50. The harness I comprises a crossing-yarn carrier 51 having a guide or deflecting element 52 and a guide 53 for the standing yarn. The element 52 is U-shaped and has two arms 54, 55 which extend around a central web 56 of the carrier 51. The element 52 is guided in the carrier 51 by means of a groove. To this end, the outside of the arm 54 is formed with a groove 58 with upstanding edges 59, 60 extending around the carrier 51 with sufficient clearance for the passage of a crossing yarn 61 (FIG. 5). Similar considerations apply to the outside of the arm 55 of the element 52. The crossing-yarn carrier 62 of the harness II is of identical construction. Each of the harnesses I, II operates in the same way as the harness shown in FIG. 1 and FIGS. 2*a* to 2*c* but in anti-synchronism. Consequently, as indicated in FIG. 6 two gauze or leno edges 63, 64 are formed with an edge 65 between them where the fabric can be subsequently cut through. This duplication is used more particularly when, for example, the yarns being woven are very smooth. The number of harnesses used depends upon requirements.

Referring to FIG. 7, a crossing-yarn carrier 70 has a U-shaped guide or deflecting element 71 in the form of a wire structure made of spring wire. The element 71 is borne at four places 72–75 but is free to move in other respects. Two bearing points 72, 74 are disposed on the sides of the carrier 70 and two bearing points 73, 75 on a central web 76 of the carrier 70. Each such place, as 74, takes the form of a groove 77 in a trough 78. When a crossing yarn passes, the yarn resiliently biases the element 21 into the shape 80 shown in dash-dotted lines so that a passage for the crossing yarn arises.

Referring to FIG. 9, the U-shaped guide or deflecting element 81 of a crossing-yarn carrier is made of spring strip having a thickened edge 82, 83 on either side. The two edges 82, 83 span the thickness of the carrier. A crossing yarn adapted to the element 81 has the reference 85.

Referring to the crossing-yarn carrier 90 of FIG. 10, a guide or deflecting element 91 is devised as in FIG. 7 from spring strip but rests on pins 92–95 secured on both sides of the carrier 90. The element 91 is formed at each pin with a recess to receive the carrier 90. As FIG. 10 shows, the element 91 is formed above the pins 94 and 95 with a respective recess 96, 97 receiving the carrier 90. Confining strips 98, 99 engage around the carrier 90. The harness operates in the manner described for the previous embodiments.

The guide or deflecting element can be V-shaped instead of U-shaped as described and shown.

Although the harness has been described herein for a weaving machine having shafts, it is of course of use for a weaving machine having a jacquard attachment.

I claim:

1. A gauze or leno harness for weaving machines comprising: a stationary frame-like crossing-yarn carrier and, secured therein at one end, a central web which forms two lanes for the crossing yarn and whose other free end forms a passage for between-lanes movement of the crossing yarn; and a guide element which is disposed near the passage in the crossing-yarn carrier and guides the crossing yarn between lanes in synchronism with shed-changing, the crossing yarn crossing in its between-lanes movement the standing yarn guided by a guide moved between the two lanes anti-synchronously to shed-changing, characterised in that the guide element has two arms which extend around the free end of the central web with a clearance at least equal to the thickness of the crossing yarn and are disposed one in each lane; and the yoke interconnecting the arms rests on an inclined base of the between-lanes passage.

2. A harness according to claim 1, characterised in that the lanes have a widening near the guide element.

3. A harness according to claim 1 or 2, characterised in that the guide element is guided in guide grooves in the crossing-yarn carrier.

4. A harness according to claim 3, characterised in that the guide grooves are disposed in the guide element.

5. A harness according to claim 1, characterised in that the guide element is formed from a spring wire retained in grooves in the crossing-yarn carrier.

6. A harness according to claim 1, characterised in that the guide element is made of spring strip whose width corresponds to the thickness of the crossing-yarn carrier and whose edges are thickened.

7. A harness according to claim 1, characterised in that the guide element is made of spring strip carried on either side of the crossing-yarn carrier on pins secured therein.

8. A leno harness for a weaving machine comprising a frame-like carrier having a central web, a pair of lanes on opposite sides of said web for guiding a crossing yarn therein and a passage having an inclined base connecting said lanes with each other for guiding the crossing yarn therebetween;

a guide for a standing yarn mounted centrally of said lanes for reciprocating movement relative to said web during a shed change; and a guide element having a pair of arms extending about said web with a clearance at least equal to the thickness of the crossing yarn and with each arm disposed in a respective lane, and a yoke interconnecting said arms and resting on said base.

9. A leno harness as set forth in claim 8 wherein each lane has a widening extending over said length of each respective arm.

10. A leno harness as set forth in claim 8 wherein said guide element includes a pair of grooves on opposite sides thereof slidably receiving said carrier therein.

11. A leno harness as set forth in claim 8 wherein said guide element is a spring wire and said carrier includes grooves receiving at least two ends of said arms therein.

12. A leno harness as set forth in claim 8 wherein said guide element is a spring strip of a width equal to the thickness of said carrier, said strip having a pair of thickened edges.

13. A leno harness as set forth in claim 8 wherein said guide element is a spring strip and said carrier includes a plurality of pins supporting said spring strip thereon.

* * * * *

UNITED STATES PATENT AND TRADEMARK OFFICE

CERTIFICATE OF CORRECTION

PATENT NO. : 4,715,408

DATED : December 29, 1987

INVENTOR(S) : FRANZ EISENLOHR

It is certified that error appears in the above-identified patent and that said Letters Patent is hereby corrected as shown below:

Column 1, lines 24, 25 "European ... 16.8" should be -U.S. Patent 4,589,450-

Column 1 between lines 30 and 31 insert "It is the object of the invention to provide a gauze or leno harness which takes up less width and in which the deflecting element does not become sluggish."

Column 2, line 54 "its" should be -a-

Column 3, line 8 "16 passage" should be -16 passes the element 20 in the passage- Column 3, line 42 "regard two" should be -regard, two-

Signed and Sealed this

Twelfth Day of July, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,715,408

DATED : December 29, 1987

INVENTOR(S) : FRANZ EISENLOHR

It is certified that error appears in the above-identified patent and that said Letters Patent is hereby corrected as shown below:

In the Front Page add:

-Assignee: Sulzer Brothers Limited
Winterthur, Switzerland

Signed and Sealed this

Sixth Day of September, 1988

*Attest:*

DONALD J. QUIGG

*Attesting Officer*

*Commissioner of Patents and Trademarks*